US007901611B2

(12) United States Patent
Wincheski

(10) Patent No.: US 7,901,611 B2
(45) Date of Patent: Mar. 8, 2011

(54) METHOD FOR PREDICTING AND OPTIMIZING SYSTEM PARAMETERS FOR ELECTROSPINNING SYSTEM

(75) Inventor: Russell A. Wincheski, Williamsburg, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 53 days.

(21) Appl. No.: 12/274,652

(22) Filed: Nov. 20, 2008

(65) Prior Publication Data

US 2009/0134552 A1 May 28, 2009

Related U.S. Application Data

(60) Provisional application No. 60/990,673, filed on Nov. 28, 2007.

(51) Int. Cl.
*B29C 47/00* (2006.01)

(52) U.S. Cl. ..... 264/465; 264/408; 264/449; 324/453; 429/92

(58) Field of Classification Search ..... 264/465, 264/408, 449; 324/453; 429/92
See application file for complete search history.

(56) References Cited

U.S. PATENT DOCUMENTS

| | | | |
|---|---|---|---|
| 4,323,525 | A | 4/1982 | Bornat |
| 4,689,186 | A | 8/1987 | Bornat |
| 5,057,253 | A | 10/1991 | Knoblach |
| 6,713,011 | B2 | 3/2004 | Chu et al. |
| 7,029,620 | B2 | 4/2006 | Gordon et al. |
| 7,070,640 | B2 | 7/2006 | Chung et al. |
| 7,086,846 | B2 * | 8/2006 | Kleinmeyer et al. .. 425/174.8 R |
| 7,135,134 | B2 | 11/2006 | Tepper et al. |
| 7,264,762 | B2 | 9/2007 | Ko et al. |
| 2002/0175449 | A1 | 11/2002 | Chu et al. |
| 2003/0137083 | A1 | 7/2003 | Ko et al. |
| 2003/0215624 | A1 | 11/2003 | Layman et al. |
| 2003/0226750 | A1 | 12/2003 | Fenn |
| 2004/0166311 | A1 | 8/2004 | Yang et al. |

(Continued)

FOREIGN PATENT DOCUMENTS

GB 2427382 A 6/2005

(Continued)

OTHER PUBLICATIONS

U.S. Appl. No. 12/131,420, Scott-Carnell et al.

(Continued)

*Primary Examiner* — Joseph S Del Sole
*Assistant Examiner* — David N Brown, II
(74) *Attorney, Agent, or Firm* — Andrea Z. Warmbier; Robin W. Edwards

(57) ABSTRACT

An electrospinning system using a spinneret and a counter electrode is first operated for a fixed amount of time at known system and operational parameters to generate a fiber mat having a measured fiber mat width associated therewith. Next, acceleration of the fiberizable material at the spinneret is modeled to determine values of mass, drag, and surface tension associated with the fiberizable material at the spinneret output. The model is then applied in an inversion process to generate predicted values of an electric charge at the spinneret output and an electric field between the spinneret and electrode required to fabricate a selected fiber mat design. The electric charge and electric field are indicative of design values for system and operational parameters needed to fabricate the selected fiber mat design.

9 Claims, 2 Drawing Sheets

U.S. PATENT DOCUMENTS

| | | | | |
|---|---|---|---|---|
| 2004/0241436 | A1 | 12/2004 | Hsieh et al. | |
| 2005/0104258 | A1 | 5/2005 | Lennhoff | |
| 2005/0123688 | A1 | 6/2005 | Craighead et al. | |
| 2006/0064196 | A1 | 3/2006 | Inkpen et al. | |
| 2006/0204750 | A1 | 9/2006 | Miyoshi et al. | |
| 2007/0018361 | A1 | 1/2007 | Xu | |
| 2007/0042069 | A1 * | 2/2007 | Armantrout et al. ... | 425/174.8 R |
| 2007/0113530 | A1 | 5/2007 | Morozov et al. | |
| 2007/0141333 | A1 | 6/2007 | Shastri et al. | |
| 2007/0269655 | A1 | 11/2007 | Joo et al. | |
| 2008/0258351 | A1 * | 10/2008 | Shieh et al. ..... | 264/466 |

FOREIGN PATENT DOCUMENTS

| | | | |
|---|---|---|---|
| WO | WO 2006/018838 | A2 | 2/2006 |

OTHER PUBLICATIONS

Carnell, Lisa S, et al., "Electric Field Effects on Fiber Alignment Using an Auxiliary Electrode during Electrospinning", 2007 Materials Research Society (MRS) Fall Meeting, Nov. 26-30, 2007, Boston, MA., pp. 359-361.

Carnell, Lisa S., et al., "Electric Field Effects on Fiber Alignment Using an Auxiliary Electrode During Electrospinning," Presentation at the MRS Conference, Nov. 29, 2007.

Materials Research Society, "Symposium FF: Synthesis and Surface Engineering of Three-Dimensional Nanostructures," Nov. 25-30, 2007.

* cited by examiner

METHOD FOR PREDICTING AND OPTIMIZING SYSTEM PARAMETERS FOR ELECTROSPINNING SYSTEM

ORIGIN OF THE INVENTION

This invention was made by an employee of the United States Government and may be manufactured and used by or for the Government of the United States of America for governmental purposes without the payment of any royalties thereon or therefor. Pursuant to 35 U.S.C. §119, the benefit of priority from provisional application 60/990,673, with a filing date of Nov. 28, 2007, is claimed for this non-provisional application, and the specification thereof is incorporated in its entirety herein by reference.

BACKGROUND OF THE INVENTION

1. Field of the Invention

This invention relates to electrospinning. More specifically, the invention is a method of predicting as well as optimizing various parameters for an electrospinning system using a single exemplary test run of the system.

2. Description of the Related Art

Electrospinning is a polymer manufacturing process that has been revived over the past decade in order to produce micro and nano-fibers as well as resulting fiber groups (or mats as they are known) with properties that can be tailored to specific applications by controlling fiber diameter and mat porosity. The individual fibers are formed by applying a high electrostatic field to a polymer solution that carries a charge sufficient to attract the solution to a grounded source. The polymer solution is ejected as a stream from a spinneret. The stream is directed towards a collector where it forms a fiber thereon. Parameters that determine fiber formation include physical system parameters defining the spinneret, the collector, and the distance between the spinneret and collector, as well as material parameters such as polymer solution viscosity, polymer/solvent interaction, surface tension, applied voltage, and the conductivity of the solution.

Typically, only non-woven mats can be produced during this process due to splaying of the fibers and jet instability of the polymer expelled from the spinneret. These non-woven mats are used as scaffolds for tissue engineering, wound dressings, clothing, filters and membranes. While non-woven mats have proven to be useful for a variety of applications, controlling fiber alignment in the mat is a desirable characteristic to expand the applications of electrospun materials. Particularly for the case of tissue engineering scaffolds, the control of fiber distribution, fiber alignment, and porosity of the scaffold are crucial for the success of any scaffold. Current manufacturing techniques are limited by erratic polymer whipping that often produces dense nano-fiber mats, which cannot support cell infiltration or cell alignment.

An improved system for aligning fibers in an electrospinning process was recently disclosed in U.S. patent application Ser. No. 12/131,420, filed Jun. 2, 2008. Briefly, this new system and technique direct a jet of a fiberizable material towards an uncharged collector from a dispensing location that is spaced apart from the collector. While the fiberizable material is directed towards the collector, an elliptical (the term "elliptical" including elliptical and all dipole field-like shapes, including both symmetric and unsymmetric, and including both spherical and ovoid) electric field is generated. The electric field spans between the dispensing location and a control location that is within line-of-sight of the dispensing location such that the electric field impinges upon at least a portion of the collector. The generation of the elliptical electric field and placement of the uncharged collector therein provide for fiber alignment when the fiberizable material is deposited on the collector. However, development of a particular fiber mat design requires a lengthy trial-and-error process to establish the various system parameters.

SUMMARY OF THE INVENTION

Accordingly, it is an object of the present invention to provide a method of selecting or predicting a number of system parameters for an electrospinning system.

Another object of the present invention is to provide a method of optimizing system parameters for an electrospinning system without requiring a lengthy trial-and-error process.

Other objects and advantages of the present invention will become more obvious hereinafter in the specification and drawings.

In accordance with the present invention, a method is provided for optimizing electrode parameters for an electrospinning configuration. The system for fabricating an aligned-fiber mat includes: a conductive, semi-conductive or non-conductive collector; an electrically-conductive spinneret having an output facing the collector and maintained in a spaced-apart relationship therewith; an electrode having a tip positioned at a control location that is spaced apart from the collector, with the collector being substantially disposed between the output and tip while they remain in line-of-sight of one another and aligned along a defined x-axis; the output and the tip having substantially the same geometric shape, the application of voltages of opposing polarity to the spinneret and electrode; and the pumping of a fiberizable material through the spinneret. The system is first operated for a fixed amount of time at known values of i) the voltages, ii) a distance between the spinneret output and the electrode tip, iii) length of the spinneret, iv) length of the electrode, v) radius of the spinneret, and vi) radius of the electrode. As a result, a fiber mat is deposited on the collector. The fiber mat has a measured fiber mat width associated therewith. Next, acceleration of the fiberizable material at the spinneret output is modeled to determine values of mass, drag, and surface tension associated with the fiberizable material at the spinneret output. Modeling is repeated until the values are in correspondence with the measured fiber mat width. The model used to determine the values of mass, drag, and surface tension is then applied in an inversion process to generate predicted values of an electric charge at the spinneret output and an electric field between the spinneret and electrode corresponding to a selected fiber mat design. More specifically, the inversion modeling uses the earlier-determined particular width and values for mass, drag, and surface tension to generate the predicted values of electric charge and electric field. The electric charge and field are indicative of design values for i) the voltages, ii) the distance between the spinneret output and electrode tip, iii) length of the spinneret, iv) length of the electrode, v) radius of the spinneret, and vi) radius of the electrode. The design values are used as the system parameters when fabricating the selected fiber mat design.

DETAILED DESCRIPTION OF THE INVENTION

Prior to describing the method of the present invention, an exemplary electrospinning system will be described. This electrospinning system is one that can benefit from the novel system parameter optimization scheme of the present invention. The electrospinning system shown and described herein has been previously disclosed in the afore cited U.S. patent application Ser. No. 12/131,420, filed Jun. 2, 2008.

Figure 1:
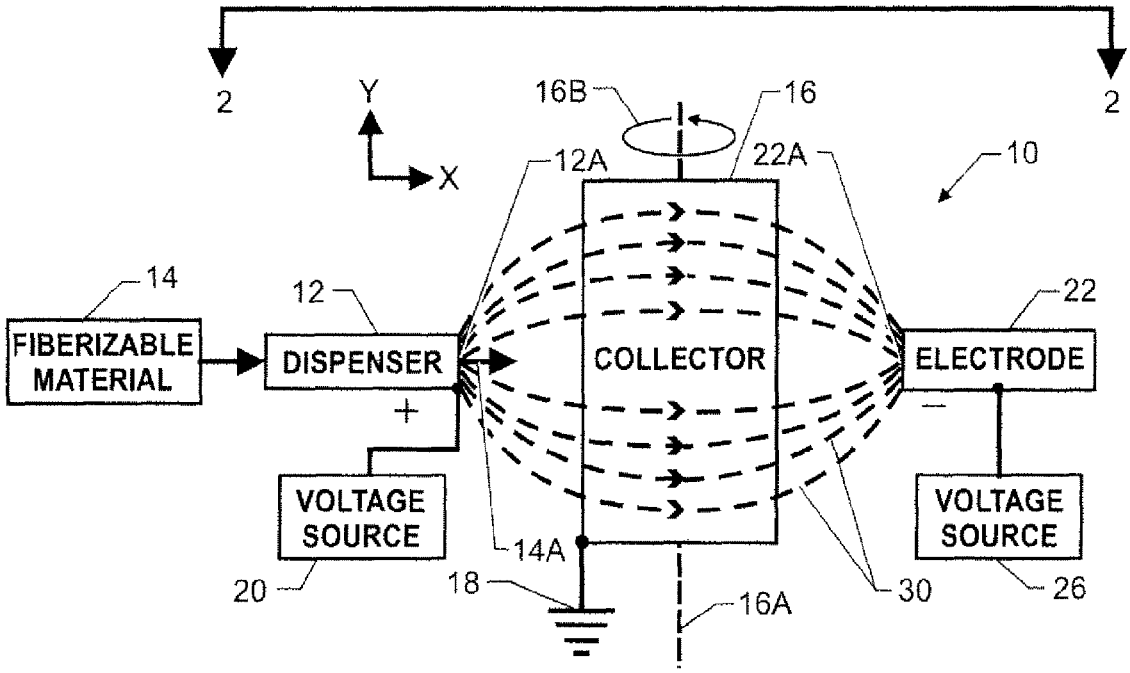
FIG. 1 is a schematic view of a system for producing aligned electrospun fibers.

Referring now to the drawings and more particularly to FIG. 1, the exemplary electrospinning system for fabricating a mat of aligned fibers is shown and is referenced generally by numeral 10. For simplicity of discussion, system 10 will be described for its use in producing a single-ply mat with aligned single fibers or fiber bundles that are substantially parallel to one another. However, as will be explained further below, the system can also be used to produce a multiple-ply mat where fiber orientation between adjacent plies is different to thereby create a porous multi-ply mat. Such multi-ply porous mats could be used in a variety of industries/applications, as would be understood by one of ordinary skill in the art.

In general, system 10 includes a dispenser 12 capable of discharging a fiberizable material 14 therefrom in jet stream form (as indicated by arrow 14A) that will be deposited as a single fiber or fiber bundles (not shown) on a collector 16. Dispenser 12 is typically a spinneret through which fiberizable material 14 is pumped, as is well known in the art of electrospinning. The type and construction of dispenser 12 will dictate whether a single fiber or fiber bundles are deposited on collector 16. Fiberizable material 14 is any viscous solution that will form a fiber after being discharged from dispenser 12 and deposited on collector 16. Typically, material 14 includes a polymeric material and can include disparate material fillers mixed therein to give the resulting fiber desired properties. Collector 16 can be a static plate, a wire mesh, a moving-conveyor-type collector, or a rotating drum fabricated in a variety of shapes and configurations, the choice of which is not a limitation of the present invention. For the illustrated example, collector 16 will be rotated about its longitudinal axis 16A as indicated by rotational arrow 16B. Collector 16 is maintained in an electrical uncharged state (e.g., floating or coupled to an electric ground potential 18 as illustrated). The fiber deposition surface of collector 16 can be electrically conductive, semi-conductive, or non-conductive.

Dispenser 12 is positioned such that its dispensing aperture 12A faces collector 16 a short distance therefrom as would be understood in the electrospinning art. For example, if dispenser 12 is a spinneret, aperture 12A represents the exit opening of the spinneret. In the present invention, the portion of dispenser 12 defining aperture 12A should be electrically conductive. Typically, dispenser 12 is a "needle electrode." As is known in the art, a needle electrode is essentially a hollow tube made from an electrically conductive material. A voltage source 20 is coupled to dispenser 12 such that an electric charge is generated at the portion of dispenser 12 defining aperture 12A.

Figure 2:
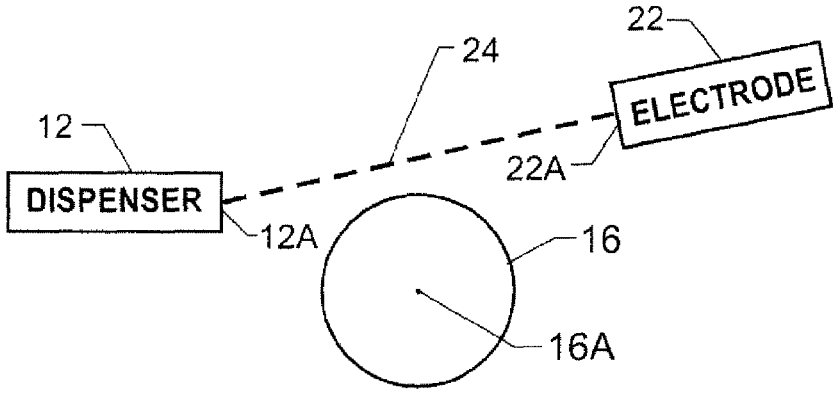
FIG. 2 is a side view of a portion of the system in FIG. 1 taken along line 2-2 thereof and illustrating positions for the fiberizable material dispenser and the electrode in accordance with an embodiment of the system.

Positioned near collector 16 and within the line-of-sight of aperture 12A is an electrode 22. More specifically, a tip 22A of electrode 22 is positioned within line-of-sight of aperture 12A as is readily seen in FIG. 2 where dashed line 24 indicates the line-of-sight communication between aperture 12A and electrode tip 22A. A voltage source 26 is coupled to electrode 22 such that an electric charge is generated at electrode tip 22A. The charge is opposite in polarity to that of the charge on the portion of dispenser 12 defining aperture 12A. That is, if the charge is positive at aperture 12A (as indicated), the charge should be negative at electrode tip 22A (as illustrated) Similarly, if the charge is negative at aperture 12A, the charge should be positive at electrode tip 22A. The magnitude of the voltages applied to dispenser 12 and electrode 22 can be the same or different, although they are typically the same.

The opposite-polarity charges at dispenser aperture 12A and electrode tip 22A cause an elliptical electric field to be generated therebetween as represented by dashed lines 30. Typically, aperture 12A and electrode tip 22A will be circular, and they can be the same or different in terms of their size. Since aperture 12A and electrode tip 22A are in line-of-sight of one another, some portion of electric field 30 will impinge upon the surface of collector 16. This will be true whether electrode tip 22A is positioned centrally with respect to collector 16 (as illustrated), or at any position along collector 16. For purpose of an illustrated example, dispenser 12 is a cylindrical needle electrode while electrode 22 is a cylindrical electrode having the same outer dimensions as dispenser 12. Further, aperture 12A and electrode tip 22A are aligned along an axis referenced by line-of-sight communication line 24.

In operation, dispenser 12 and electrode 22 are positioned with respect to collector 16 as described above. Opposite-polarity voltages are applied to dispenser 12 and electrode 22 in order to establish electric field 30 with at least a portion of collector 16 being disposed in electric field 30. Fiberizable material 14 is plumped from dispenser 12 such that a jet stream 14A thereof is subject to electric field 30. A pulsed electric field, generated for example by pulsing the voltages applied to dispenser 12 and electrode 22, may also be used.

Figure 3:
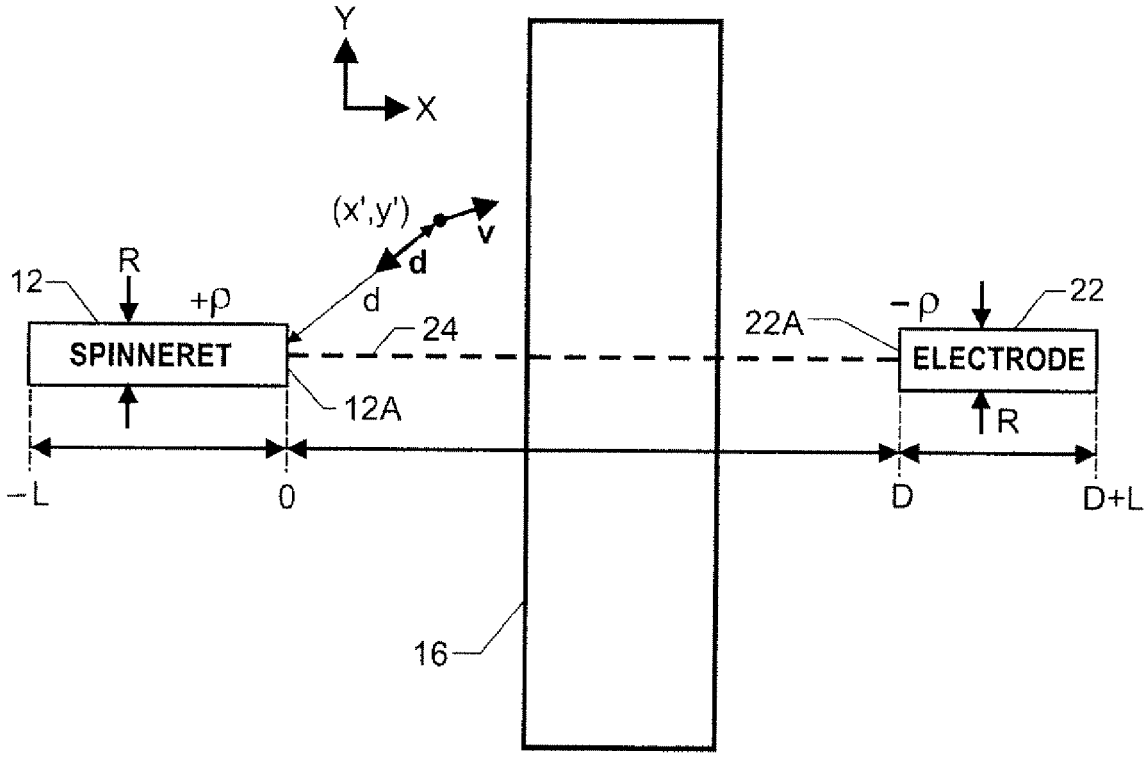
FIG. 3 is a diagrammatic representation of the fiberizable material dispenser, collector, and electrode illustrating various system parameter relationships.

As mentioned above, the present invention is a method of predicting and optimizing the various physical system parameters for an electrospinning system such as the one described herein. A diagrammatic representation of dispenser 12 (e.g., a cylindrical needle electrode), collector 16 (e.g., a rotating drum), and electrode 22 (e.g., a cylindrical electrode), is illustrated in FIG. 3 with various system parameters being denoted. It is to be understood that relative sizes of and distances between dispenser 12, collector 16, and electrode 22 are not to scale as they are merely sized and positioned to facilitate a description of the present invention. The line-of-sight communication axis 24 forms the x-axis for the relationships discussed below. The y-axis denotes the reference direction for the width of the fiber mat (not shown) that gets deposited on collector 16 during the electrospinning process.

The external dimensions of dispenser 12 and electrode 22 are the same for the following explanation where the length of cylindrical dispenser 12 and cylindrical electrode 22 is "L", and the distance between dispenser aperture 12A and electrode tip 22A is "D". These parameters are illustrated along the x-axis and are referenced to an origin defined at dispenser aperture 12A. Points in a spatial region of free-space between dispenser aperture 12A and electrode tip 22A are referenced by coordinate (x',y') The charge density on dispenser 12 due to an applied voltage is "ρ", and the charge density on electrode 22 due to an equal and opposite applied voltage is "−ρ". The external radius of dispenser 12 and electrode 22 is "R", Using an electrospinning system as described above, the present invention first requires an exemplary test run of the system in order to generate a sample fiber mat where the width dimension thereof is used in the predicting/optimizing scheme. Briefly and with simultaneous reference to FIGS. 1-3, system 10 is operated for some short and fixed period of time (e.g., on the order of seconds) with the various system parameters being known. That is, system 10 is set up such that voltage sources 20 and 26 apply equal and opposite voltages to dispenser 12 and electrode 22, respectively. Further, distance D is known, length L is known (and the same for dispenser 12 and electrode 22 in this example), and the radius R of dispenser 12 and electrode 22 is known (and the same in this example). As a result of this operation, a sample fiber mat (not shown) will be deposited on collector 16. The width of the fiber mat along the axial length of collector 16 (i.e., perpendicular to axis 24) is measured and is designated herein as "$y_N$".

In the remaining steps of the present invention, well known electric field/potential relationships (as they apply to electrospinning) and a novel particle acceleration model are used to predict and optimize various system parameters when a particular fiber mat design is to be fabricated. The development of the model will now be explained.

The electric field generated between dispenser aperture 12A and electrode tip 22 is the negative gradient of the electric potential, given by the well known relationship $$E=-\nabla V \tag{1}$$

where E is the electric field and V is the electric potential that can be calculated for points in the free-space region between dispenser aperture 12A and electrode tip 22A in accordance with $$V(x, y) = \frac{1}{\varepsilon_0}\left(\frac{q_1}{r_1} + \frac{q_2}{r_2}\right) \tag{2}$$

where $q_1$ is the charge on dispenser 12 for a given applied voltage, $q_2$ is the charge on electrode 22 for a given applied voltage, $r_1$ is the distance from the charge at dispenser 12 to the location (x,y) in the free-space region, $r_2$ is the distance from the charge at electrode 22 to the location (x,y) in the free-space region, and $$\varepsilon_o = 8.8541878176\times 10^{-12}\frac{C^2}{J\cdot m}$$

is the permittivity of free space.

For the exemplary arrangement at some point (x',y') in the free-space region, $$V(x', y') = \frac{\rho}{\varepsilon_0}\int_{-L}^{0}\frac{dx}{((x'-x)^2+y'^2)^{1/2}} + -\rho\int_{D}^{D+L}\frac{dx}{((x'-x)^2+y'^2)^{1/2}} \tag{3}$$

where the charge density ρ is calculated based upon the required voltage to bring the potential on dispenser 12 and electrode 22 to the operating voltage $V_O$. The charge density is given by $$\rho = \pm V_O\varepsilon_0 \Big/ \int_{-L/2}^{L/2} dx/(x^2+R^2)^{1/2} \tag{4}$$

In these equations for the exemplary arrangement, D is the distance between dispenser aperture 12A and electrode tip 22A, L is the length of dispenser 12 and electrode 22, R is the radius of dispenser 12 and electrode 22, and $$\varepsilon_o = 8.8541878176\times 10^{-12}\frac{C^2}{J\cdot m}$$

is the permittivity of free space.

By assuming that the charge $q_0$ on a droplet of polymer at dispenser aperture 12A is that required to bring the surface potential to the operating voltage, all parameters needed to calculate the electrostatic force "F" throughout the above-defined free-space region can be defined. The acceleration vector "A" for the polymer droplet can be written in accordance with the well known relationship $$A = \frac{F}{m} = \frac{q_0 E}{m} \tag{5}$$

where "m" is the mass of the polymer particle.

In addition to the electrostatic forces, the polymer kinetics are dependent upon drag and the surface tension of the polymer as it exits dispenser 12. In the exemplary system described above, these effects can be modeled as additional forces on the polymer droplet. Drag "μ" is modeled as a force proportional to the square of the velocity "v" of the droplet in the opposite direction of the droplet's velocity vector "v". Surface tension "σ" is modeled as a force inversely proportional to the cube of the distance "d" between dispenser aperture 12A and the droplet along the vector "d" from the droplet to dispenser aperture 12A. Thus, the novel acceleration model applied in the present invention models the kinetics of the polymer during electrospinning as follows $$A_i = \frac{1}{m}\left(q_0 E - \mu v_i^2\frac{v_i}{|v_i|} - \frac{\sigma}{d_i^3}\frac{d_i}{|d_i|}\right), \tag{6a}$$

$$v_{i+1} = A_i\Delta t + v_i, \tag{6b}$$

$$d_{i+1} = A_i\frac{(\Delta t)^2}{2} + v_1(\Delta t) + d_i, \tag{6c}$$

$$d_n = x_n x + y_n y \tag{6d}$$

where $q_0$ is the charge on the droplet exiting dispenser aperture 12A,

E is an electric field between dispenser 12A and electrode 22, $v_i$ is the velocity of the droplet at an instant (Δt*i) in a fixed amount of system operating time, $v_i$ is the velocity vector at the i-th instant, $d_i$ is a distance from dispenser aperture 12A to the droplet at the i-th instant, $d_i$ is the distance vector associated with the distance $d_i$, x is a unit vector aligned with the x-axis defined by line-of-sight axis 24, y is a unit vector perpendicular to the x-axis, $x_n$ is equal to the distance D, and $y_n$ is equal to the width of the fiber mat deposited on collector 16 during the fixed amount of system operating time.

In accordance with the present invention, the particle acceleration model presented in equations (6a)-(6d) is first used in an iteration process. Specifically, the model is iterated over the amount of time used to create the sample fiber mat in order to generate values for mass m, drag μ, and surface tension σ that will yield, at the n-th time step, a calculated fiber mat width $y_n$ that is equal to (or within an acceptable tolerance) of the sample fiber mat width $y_M$. As would be understood by one of ordinary skill in the art, the iteration process begins with some selected initial values for mass, drag, and surface tension.

Following the iteration process, the determined values for mass, drag, and surface tension are used in an inversion application of the particle acceleration model that yields optimized predictions of system parameters. More specifically, the inversion application solves the particle acceleration model using a combination of (i) a value for $y_n$ that is set equal to a desired fiber mat width, and (ii) the determined values of mass, drag, and surface tension. Solving the model with these given parameter values yields both the required charge and the electric field. The above-described equations (1)-(4) are then used in a straight-forward fashion to define the operating voltages $V_O$, distance D, length L, and radius R.

The present invention is further described in Carnell, Lisa S.; Wincheski, Russell A.; Siochi, Emilie, J.; Holloway, Nancy M.; and Clark, Robert L., "Electric Field Effects on Fiber Alignment Using an Auxiliary Electrode during Electrospinning," 2007 Materials Research Society (MRS) Fall Meeting, 29 Nov. 2007, Boston, Mass., the contents of which are hereby incorporated by reference in their entirety.

The advantages of the present invention are numerous. Parameter prediction and optimization for a recently-developed electrospinning technique will enhance the value thereof. The results of a single sample run for the electrospinning system in combination with a novel particle acceleration model will allow system parameters to be defined without time-consuming trial-and-error processing.

Although the invention has been described relative to a specific embodiment thereof, there are numerous variations and modifications that will be readily apparent to those skilled in the art in light of the above teachings. The present invention can be readily extended to electrospinning systems using a dispenser and electrode of differing length and/or radius dimensions. For example, if the lengths are different, the first integral in equation (3) is bounded on one side by $-L_1$, and the second integral in equation (3) is bounded on one side by $D+L_2$, where $L_1$ is the length of dispenser 12 and $L_2$ is the length of electrode 22. If the radius dimensions are different, equation (4) is calculated twice, i.e., one time to generate a charge density for dispenser 12 using the radius thereof and the potential applied thereto, and a second time to generate a charge density for electrode 22 using the radius thereof and the potentials applied thereto. The "dispenser" charge density would then be used for the first term in equation (3), while the "electrode" charge density would then be used for the second term of equation (3). It is therefore to be understood that, within the scope of the appended claims, the invention may be practiced other than as specifically described.

What is claimed as new and desired to be secured by Letters Patent of the United States is:

1. A method of optimizing electrode parameters for an electrospinning configuration, comprising the steps of:

providing a system for fabricating an aligned-fiber mat, said system including an uncharged collector, an electrically-conductive spinneret having an output facing said collector and maintained in a spaced-apart relationship therewith, an electrode having a tip positioned at a control location that is spaced apart from said collector with said collector being substantially disposed between said output and said tip while said output and said tip remain in line-of-sight of one another and aligned along a defined x-axis, said output and said tip having substantially the same geometric shape, means for applying voltages of opposing polarity to said spinneret and said electrode, and means for pumping a fiberizable material through said spinneret;

operating said system for a fixed amount of time at known values of i) said voltages, ii) a distance between said output of said spinneret and said tip of said electrode, iii) length of said spinneret, iv) length of said electrode, v) radius of said spinneret, and vi) radius of said electrode, wherein a fiber mat made from said fiberizable material is deposited on said collector, said fiber mat having a measured fiber mat width $y_M$ associated therewith;

iterating through a particle acceleration model $$A_i = \frac{1}{m}\left(q_0 E - \mu v_i^2 \frac{v_i}{|v_i|} - \frac{\sigma}{d_i^3}\frac{d_i}{|d_i|}\right),$$

$$v_{i+1} = A_i \Delta t + v_i,$$

$$d_{i+1} = A_i \frac{(\Delta t)^2}{2} + v_1(\Delta t) + d_i,$$

$$d_n = x_n x + y_n y$$

over said fixed amount of time to determine values for mass (m), drag (μ), and surface tension (σ) associated with said fiberizable material at said output of said spinneret that reduces a difference between said measured fiber mat width $y_M$ and a calculated fiber mat width $y_n$ to a selected tolerance, wherein $q_0$ is a charge on said fiberizable material exiting said output of said spinneret, E is an electric field between said spinneret and said electrode, $v_i$ is a velocity of said fiberizable material at an instant (Δt*i) in said fixed amount of time, $v_i$ is a velocity vector associated with said velocity at said instant, $d_i$ is a distance from said output of said spinneret to said fiberizable material exiting said spinneret at said instant, $d_i$ is a distance vector associated with said distance at said instant, x is a unit vector aligned with said x-axis, y is a unit vector perpendicular to said x-axis, and $x_n$ is equal to a distance between said output of said spinneret and said collector;

selecting a fiber mat design defined by a particular width and fiber distribution across said particular width; and solving said particle acceleration model to yield calculated values for said charge and said electric field corresponding to said fiber mat design so-selected wherein said step of solving defines said calculated fiber mat width $y_n$ to said particular width and uses said values for said mass, said drag, and said surface tension so-determined, and wherein said calculated values of said charge and said electric field are indicative of optimized design values for i) said voltages, ii) said distance between said output of said spinneret and said tip of said electrode, iii) said length of said spinneret, iv) said length of said electrode, v) said radius of said spinneret, and vi) said radius of said electrode.

2. A method as in claim 1, wherein said length of said spinneret and said length of said electrode are equal.

3. A method as in claim 1, wherein said radius of said spinneret and said radius of said electrode are equal.

4. A method as in claim 2, wherein said radius of said spinneret and said radius of said electrode are equal.

5. A method of optimizing electrode parameters for an electrospinning configuration, comprising the steps of:

providing a system for fabricating an aligned-fiber mat, said system including an uncharged collector, an electrically-conductive spinneret having an output facing said collector and maintained in a spaced-apart relationship therewith, an electrode having a tip positioned at a control location that is spaced apart from said collector with said collector being substantially disposed between said output and said tip while said output and said tip remain in line-of-sight of one another and aligned along a defined x-axis, said output and said tip having substantially the same geometric shape, means for applying voltages of opposing polarity to said spinneret and said electrode, and means for pumping a fiberizable material through said spinneret;

operating said system for a fixed amount of time at known values of i) said voltages, ii) a distance between said output of said spinneret and said tip of said electrode, iii) length of said spinneret, iv) length of said electrode, v) radius of said spinneret, and vi) radius of said electrode, wherein said length of said spinneret and said length of said electrode are equal, wherein said radius of said spinneret and said radius of said electrode are equal, and wherein a fiber mat made from said fiberizable material is deposited on said collector, said fiber mat having a measured fiber mat width $y_M$ associated therewith;

iterating through a particle acceleration model $$A_j = \frac{1}{m}\left(q_0 E - \mu v_i^2 \frac{V_i}{|v_i|} - \frac{\sigma}{d_i^3}\frac{d_i}{|d_i|}\right),$$

$$v_{i+1} = A_i \Delta t + v_i,$$

$$d_{i+1} = A_i \frac{(\Delta t)^2}{2} + v_i(\Delta t) + d_i,$$

$$d_n = x_n x + y_n y$$

over said fixed amount of time to determine values for mass (m), drag (μ), and surface tension (σ) associated with said fiberizable material at said output of said spinneret that reduces a difference between said measured fiber mat width $y_M$ and a calculated fiber mat width yn to a selected tolerance, wherein $q_0$ is a charge on said fiberizable material exiting said output of said spinneret, E is an electric field between said spinneret and said electrode, $v_i$ is a velocity of said fiberizable material at an instant (Δt*i) in said fixed amount of time, $v_i$ is a velocity vector associated with said velocity at said instant, $d_i$ is a distance from said output of said spinneret to said fiberizable material exiting said spinneret at said instant, $d_i$ is a distance vector associated with said distance at said instant, x is a unit vector aligned with said x-axis, y is a unit vector perpendicular to said x-axis, and $x_n$ is equal to a distance between said output of said spinneret and said collector;

selecting a fiber mat design defined by a particular width and fiber distribution across said particular width; and solving said particle acceleration model to yield calculated values for said charge and said electric field corresponding to said fiber mat design so-selected wherein said step of solving uses said values for said mass, said drag, and said surface tension so-determined, and wherein said calculated values of said charge and said electric field are indicative of design values for i) said voltages, ii) said distance between said output of said spinneret and said tip of said electrode, iii) said length of said spinneret, iv) said length of said electrode, v) said radius of said spinneret, and vi) said radius of said electrode, wherein said design values are determined from a relationship governing electric potential V in a free-space region between said output of said spinneret and said tip of said electrode, said relationship defined as $$V(x', y') = \frac{\rho}{\varepsilon_0}\int_{-L}^{0} \frac{dx}{((x'-x)^2 + y'^2)^{1/2}} - \frac{\rho}{\varepsilon_0}\int_{D}^{D+L} \frac{dx}{((x'-x)^2 + y'^2)^{1/2}}$$

where charge density ρ is given by $$\rho = \pm V_O \varepsilon_0 \Big/ \int_{-L/2}^{L/2} dx/(x^2 + R^2)^{1/2}$$

where x' and y' define coordinates in said free-space region,

L is said design value for each of said length of said spinneret and said length of said electrode, D is said design value for said distance between said output of said spinneret and said tip of said electrode, $\pm V_O$ are said design values for said voltages, R is said design value for each of said radius of said spinneret and said radius of said electrode, and $$\varepsilon_o = 8.8541878176 \times 10^{-12} \frac{C^2}{J \cdot m}$$

is a constant equal to the permittivity of free space.

6. A method of optimizing electrode parameters for an electrospinning configuration, comprising the steps of:

providing a system for fabricating an aligned-fiber mat, said system including an uncharged collector, an electrically-conductive spinneret having an output facing said collector and maintained in a spaced-apart relationship therewith, an electrode having a tip positioned at a control location that is spaced apart from said collector with said collector being substantially disposed between said output and said tip while said output and said tip remain in line-of-sight of one another and aligned along a defined x-axis, said output and said tip having substantially the same geometric shape, means for applying voltages of opposing polarity to said spinneret and said electrode, and means for pumping a fiberizable material through said spinneret;

operating said system for a fixed amount of time at known values of i) said voltages, ii) a distance between said output of said spinneret and said tip of said electrode, iii) length of said spinneret, iv) length of said electrode, v) radius of said spinneret, and vi) radius of said electrode, wherein a fiber mat made from said fiberizable material is deposited on said collector, said fiber mat having a measured fiber mat width associated therewith;

modeling acceleration of said fiberizable material at said output of said spinneret to thereby determine values of mass, drag, and surface tension associated with said fiberizable material at said output of said spinneret, wherein said step of modeling is repeated until said values so-determined correspond to said measured fiber mat width;

selecting a fiber mat design defined by a particular width; and inverse modeling acceleration of said fiberizable material at said output of said spinneret to generate predicted values of an electric charge at said output and an electric field between said spinneret and said electrode corresponding to said fiber mat design so-selected wherein said step of inverse modeling uses said particular width and said values for said mass, said drag, and said surface tension so-determined, and wherein said predicted values of said electric charge and said electric field are indicative of optimized design values for i) said voltages, ii) said distance between said output of said spinneret and said tip of said electrode, iii) said length of said spinneret, iv) said length of said electrode, v) said radius of said spinneret, and vi) said radius of said electrode.

7. A method as in claim 6, wherein said length of said spinneret and said length of said electrode are equal.

8. A method as in claim 6, wherein said radius of said spinneret and said radius of said electrode are equal.

9. A method as in claim 7, wherein said radius of said spinneret and said radius of said electrode are equal.

* * * * *